US009610777B2

(12) United States Patent
Asada et al.

(10) Patent No.: US 9,610,777 B2
(45) Date of Patent: Apr. 4, 2017

(54) PRINTING CONTROL APPARATUS, PRINTING CONTROL METHOD, AND PROGRAM

(71) Applicant: SEIKO EPSON CORPORATION, Tokyo (JP)

(72) Inventors: Tatsuya Asada, Shiojiri (JP); Tomoyuki Nakano, Shiojiri (JP); Takashi Kobayashi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/615,300

(22) Filed: Feb. 5, 2015

(65) Prior Publication Data

US 2015/0224789 A1 Aug. 13, 2015

(30) Foreign Application Priority Data

Feb. 10, 2014 (JP) ..... 2014-023083

(51) Int. Cl.
*B41J 2/21* (2006.01)
*B41J 2/175* (2006.01)

(52) U.S. Cl.
CPC ..... *B41J 2/2132* (2013.01); *B41J 2/17546* (2013.01); *B41J 2/17553* (2013.01)

(58) Field of Classification Search
CPC ..... B41J 2/165; B41J 2/16517; B41J 2/1652; B41J 2/16505; B41J 2/1707; B41J 2/1714; B41J 2/16579; B41J 2/17559; B41J 2/1753; B41J 2/17513; B41J 2002/16502; B41J 2/2132
USPC ..... 347/5, 9, 12, 14, 15, 20, 40, 44, 47, 86
See application file for complete search history.

(56) References Cited

U.S. PATENT DOCUMENTS

| | | | | |
|---|---|---|---|---|
| 6,361,138 | B1 * | 3/2002 | Seino et al. | 347/19 |
| 6,679,575 | B2 | 1/2004 | Someno | |
| 2002/0118244 | A1 * | 8/2002 | Yonekubo | 347/19 |
| 2003/0137552 | A1 * | 7/2003 | Im | B41J 2/1652 347/23 |
| 2006/0203034 | A1 * | 9/2006 | Uetsuki | B41J 2/16544 347/33 |
| 2006/0284922 | A1 * | 12/2006 | Beak | 347/23 |
| 2014/0152725 | A1 * | 6/2014 | Tomizawa et al. | 347/9 |

FOREIGN PATENT DOCUMENTS

| | | | |
|---|---|---|---|
| JP | 2002-292836 | A | 10/2002 |
| JP | 2006-166092 | A | 6/2006 |
| JP | 2006-240030 | A | 9/2006 |
| JP | 2011-218560 | A | 11/2011 |

* cited by examiner

*Primary Examiner* — Stephen Meier
*Assistant Examiner* — Sharon A Polk
(74) *Attorney, Agent, or Firm* — Maschoff Brennan

(57) ABSTRACT

A printing control apparatus controls ejection of a pigment ink, supplied from a cartridge, from a nozzle row having a plurality of nozzles. Time information regarding an elapsed time of the cartridge is obtained, and used nozzles, in the nozzle row, that eject the pigment ink are reduced based on the time information of the cartridge.

8 Claims, 8 Drawing Sheets

PRINTING CONTROL APPARATUS, PRINTING CONTROL METHOD, AND PROGRAM

CROSS-REFERENCE TO RELATED APPLICATIONS

This application claims priority to Japanese Patent Application No. 2014-023083 filed on Feb. 10, 2014. The entire disclosure of Japanese Patent Application No. 2014-023083 is hereby incorporated herein by reference.

BACKGROUND

1. Technical Field

The present invention relates to printing control apparatuses, printing control methods, and programs.

2. Related Art

Ink jet printers, which eject ink, are being developed. Some ink jet printing apparatuses use pigment ink, but pigment ink has a problem in that the pigment contained therein settles.

JP-A-2011-218560 discloses adjusting an ink ejection amount from nozzle to nozzle based on an amount of such settling.

Some printers use ink cartridges in which pigment ink is caused to permeate a sponge-type material in order to prevent the ink from leaking. When such an ink cartridge is used, density unevenness, in which densities differ between images formed by nozzles in a central area of a nozzle row and images formed by nozzles on end areas of the nozzle row, may occur depending on how long the ink cartridge has not been used. As density unevenness reduces printing quality, it is desirable to suppress such density unevenness.

SUMMARY

An advantage of some aspects of the invention is to suppress the occurrence of density unevenness.

A printing control apparatus according to a first aspect of the invention is a printing control apparatus that controls ejection of a pigment ink, supplied from a cartridge, from a nozzle row having a plurality of nozzles, in which time information regarding an elapsed time of the cartridge is obtained, and used nozzles, in the nozzle row, that eject the pigment ink are reduced based on the time information of the cartridge.

Other features of the invention will be made clear by the descriptions in this specification and the appended drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
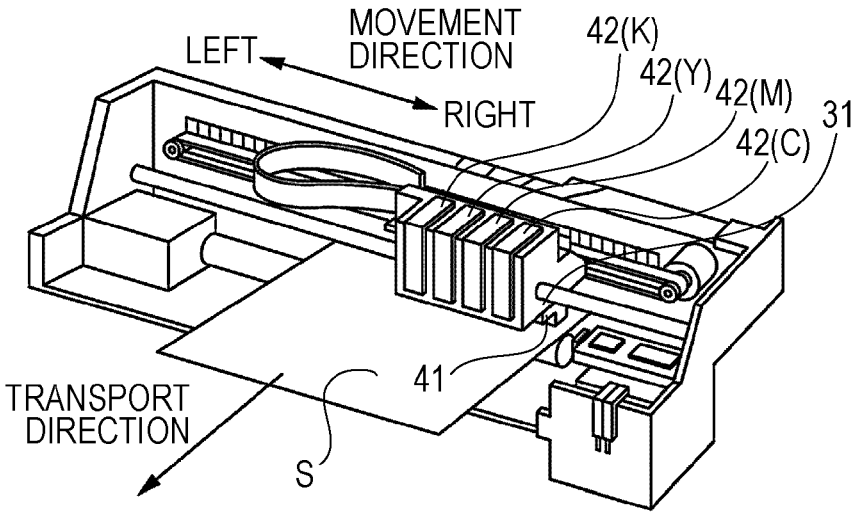
FIG. 1 is a perspective view of a printer.

The descriptions in this specification and the appended drawings will make clear at least the following points.

A printing control apparatus controls ejection of a pigment ink, supplied from a cartridge, from a nozzle row having a plurality of nozzles. Here, time information regarding an elapsed time of the cartridge is obtained, and used nozzles, in the nozzle row, that eject the pigment ink are reduced based on the time information of the cartridge.

The pigment ink settles when the elapsed time of the cartridge lengthens, and there is a resulting risk that the density of the ejected pigment ink will differ from nozzle to nozzle in the nozzle row; however, according to the above configuration, the number of used nozzles can be reduced based on the elapsed time, and thus density differences in the ejected pigment ink from nozzle to nozzle in the nozzle row can be reduced. The occurrence of density unevenness can be suppressed as a result.

In the printing control apparatus, it is desirable that when reducing a number of the used nozzles, the used nozzles are reduced so that nozzles toward the center of the nozzle row are used.

In the case where, for example, the nozzles at the end areas are used instead of the nozzles toward the center, the pigment ink will be ejected by nozzles on an upper end side and nozzles on a lower end side. In other words, two bands will be formed each time the nozzle row moves once, but in this case, it is difficult to coordinate the positioning of the two bands and so on, which in turn complicates the printing process. As opposed to this, in the case where the used nozzles are reduced so that nozzles toward the center are used, only a single band will be formed by the nozzles toward the center, which makes it comparatively easy for the printing process to progress.

In addition, it is desirable that a different method for reducing the used nozzles is used for each color of the pigment ink.

Density differences between inks caused by the degrees to which the inks settle differ from ink color to ink color, and thus using different methods for reducing the used nozzles for each color of the pigment ink makes it possible to reduce density differences between respective ink colors.

In addition, it is desirable that when reducing the used nozzles that eject the pigment ink, a rate at which the used nozzles for yellow ink are reduced is slower than a rate at which the used nozzles for other colors of ink are reduced.

Yellow ink has a lower ink density difference between nozzles, caused by the degree to which the ink settles, than other inks, and thus the rate at which the used nozzles for the yellow ink are reduced can be made slower than the rate at which the used nozzles for the other colors of ink are reduced.

In addition, it is desirable that the cartridge contains a material permeated with the pigment ink.

Doing so makes it possible to use a cartridge from which the pigment ink does not easily leak. Although it is easy for density differences to arise from nozzle to nozzle due to ink settling in such a cartridge, the nozzles that are used can be reduced as described above, which makes it possible to reduce the density difference.

In addition, it is desirable that the elapsed time of the cartridge is a time related to an amount of time from when the cartridge was manufactured.

By doing so, the nozzles that are used can be reduced based on the elapsed time from when the cartridge was manufactured.

In addition, the descriptions in this specification and the appended drawings will make clear at least the following points as well.

A printing control method that controls ejection of a pigment ink, supplied from a cartridge, from a nozzle row having a plurality of nozzles, includes obtaining time information regarding an elapsed time of the cartridge, and reducing the nozzles in the nozzle row that are used based on the time information and ejecting the pigment ink.

The pigment ink settles when the elapsed time of the cartridge lengthens, and there is a resulting risk that the density of the ejected pigment ink will differ from nozzle to nozzle in the nozzle row; however, according to the above configuration, the number of used nozzles can be reduced based on the elapsed time, and thus density differences in the ejected pigment ink from nozzle to nozzle in the nozzle row can be reduced. The occurrence of density unevenness can be suppressed as a result.

In addition, the descriptions in this specification and the appended drawings will make clear at least the following points as well.

A program that causes a printing control apparatus to control ejection of a pigment ink, supplied from a cartridge, from a nozzle row having a plurality of nozzles, causes the apparatus to obtain time information regarding an elapsed time of the cartridge, and reduce the nozzles in the nozzle row that are used based on the time information and ejecting the pigment ink.

The pigment ink settles when the elapsed time of the cartridge lengthens, and there is a resulting risk that the density of the ejected pigment ink will differ from nozzle to nozzle in the nozzle row; however, according to the above configuration, the number of used nozzles can be reduced based on the elapsed time, and thus density differences in the ejected pigment ink from nozzle to nozzle in the nozzle row can be reduced. The occurrence of density unevenness can be suppressed as a result.

First Embodiment

Figure 2:
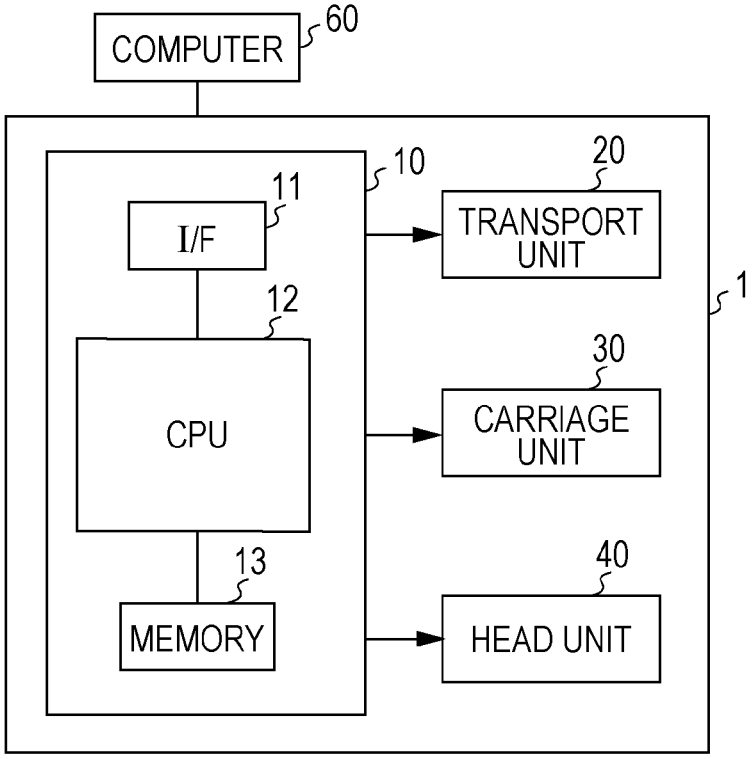
FIG. 2 is a block diagram illustrating the overall configuration of a printer.

FIG. 1 is a perspective view of a printer 1. FIG. 2 is a block diagram illustrating the overall configuration of the printer 1. A computer 60 is connected to the printer 1 in a communicable state, and sends, to the printer 1, print data for causing the printer 1 to print images. Note that a program for converting image data outputted from an application program into print data (a printer driver) is installed in the computer 60. The printer driver is recorded on a recording medium (a computer-readable recording medium) such as a CD-ROM, made downloadable to the computer over the Internet, or the like.

As will be described later, the computer 60 limits nozzles that eject ink (used nozzles) based on an amount of time that has passed following the manufacture date of a cartridge. As such, the computer 60 that controls the ejection of ink corresponds to a printing control apparatus.

A controller 10 is a control unit for controlling various units in the printer 1. An interface unit 11 is a unit used for exchanging data between the computer 60 and the printer 1. A CPU 12 is a computational processing device for carrying out the overall control of the printer 1. A memory 13 is a unit for securing a region for storing programs executed by the CPU 12, a work region, and so on.

A transport unit 20 feeds a medium S to a location where printing can be carried out, and transports the medium S in a transport direction by a predetermined transport amount during printing. A carriage unit 30 is a unit for moving a head 41 in a movement direction, which is orthogonal to the transport direction, and includes a carriage 31.

A head unit 40 is a unit for ejecting ink onto the medium S, and includes the head 41. The head 41 is moved in the movement direction by the carriage 31. A plurality of nozzles, serving as an ink ejection portion, are provided in a bottom surface of the head 41, and an ink chamber (not shown) holding ink is provided for each of the nozzles.

Ink cartridges 42, holding black ink K, yellow ink Y, magenta ink M, and cyan ink C, respectively, are attached to the carriage 31. These colors of ink are supplied to the head 41 from the corresponding cartridges 42.

Figure 3:
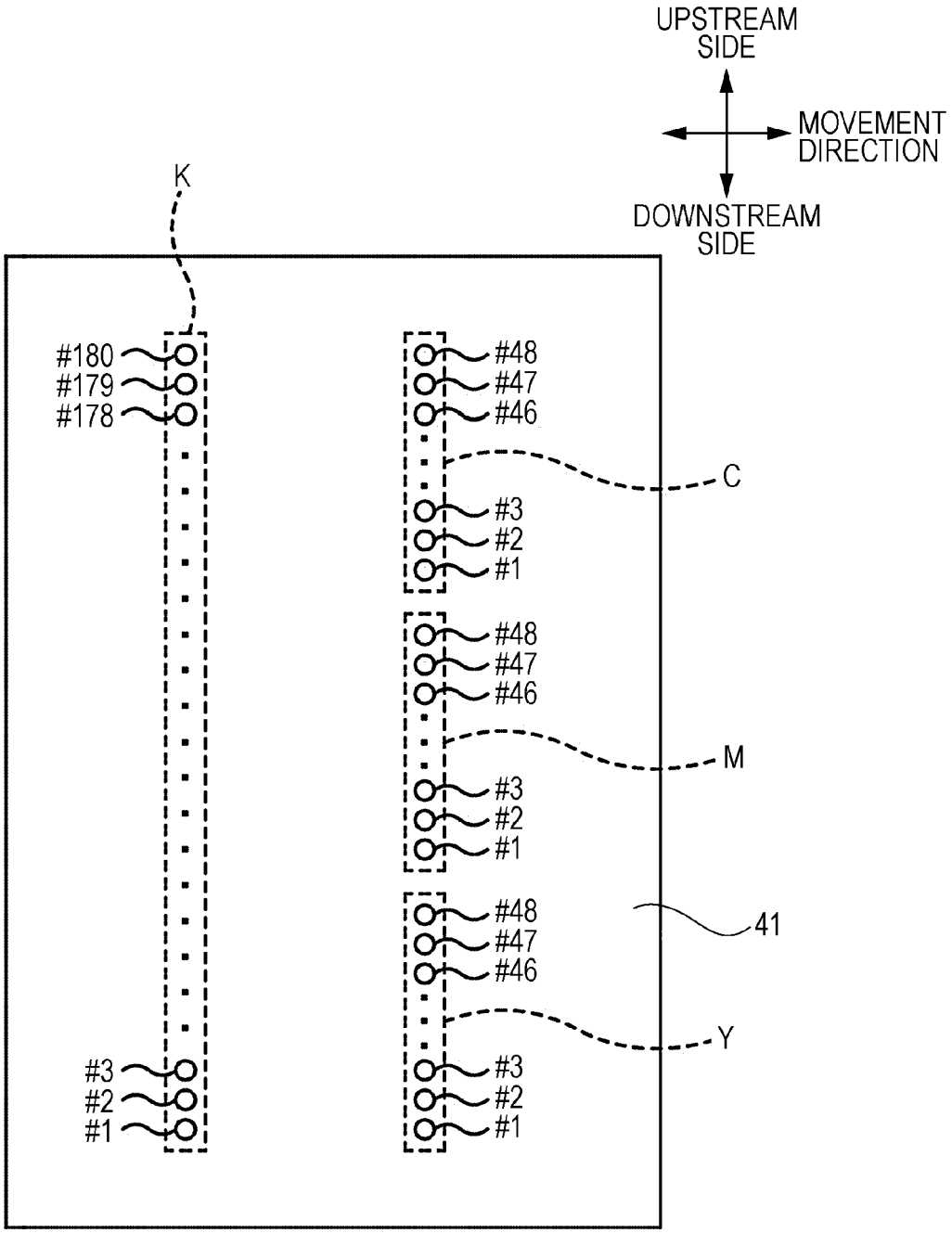
FIG. 3 is a diagram illustrating a nozzle array provided in a bottom surface of a head.

FIG. 3 is a diagram illustrating an arrangement of the nozzles provided in the bottom surface of the head 41. Note that FIG. 3 is a diagram illustrating the nozzles from a top surface of the head 41, with the remainder of the head 41 being omitted from the drawing. Two nozzle rows are formed along the movement direction of the head 41 in the bottom surface of the head 41. One of the nozzle rows is a nozzle row for ejecting the black ink K, and 180 nozzles are arranged in the transport direction at predetermined intervals. Meanwhile, the other nozzle row is a nozzle row for ejecting the cyan ink C, the magenta ink M, and the yellow ink Y.

The nozzle row for the cyan ink C, the magenta ink M, and the yellow ink Y includes nozzle rows having 48 nozzles for each of those colors. These respective nozzle rows are arranged on the same line. The nozzles in each of these nozzle rows are arranged at the same predetermined intervals as the nozzles for the black ink K. The nozzle row for the cyan ink C, the nozzle row for the magenta ink M, and the nozzle row for the yellow ink Y are arranged having a small gap between each other in the transport direction.

The nozzles in the nozzle rows for each color of ink are assigned numbers in order from the nozzles on a downstream side in the transport direction, and these numbers will be referred to as nozzle numbers.

This printer 1 repeats a dot formation process that forms dots on the medium by intermittently ejecting ink droplets from the head 41 that moves along the movement direction and a transport process that transports the medium in the transport direction relative to the head 41. By doing so, a later dot formation process can form dots in different positions on the medium from the positions in which dots have been formed by a previous dot formation process, and a two-dimensional image can be printed on the medium.

Figure 4:
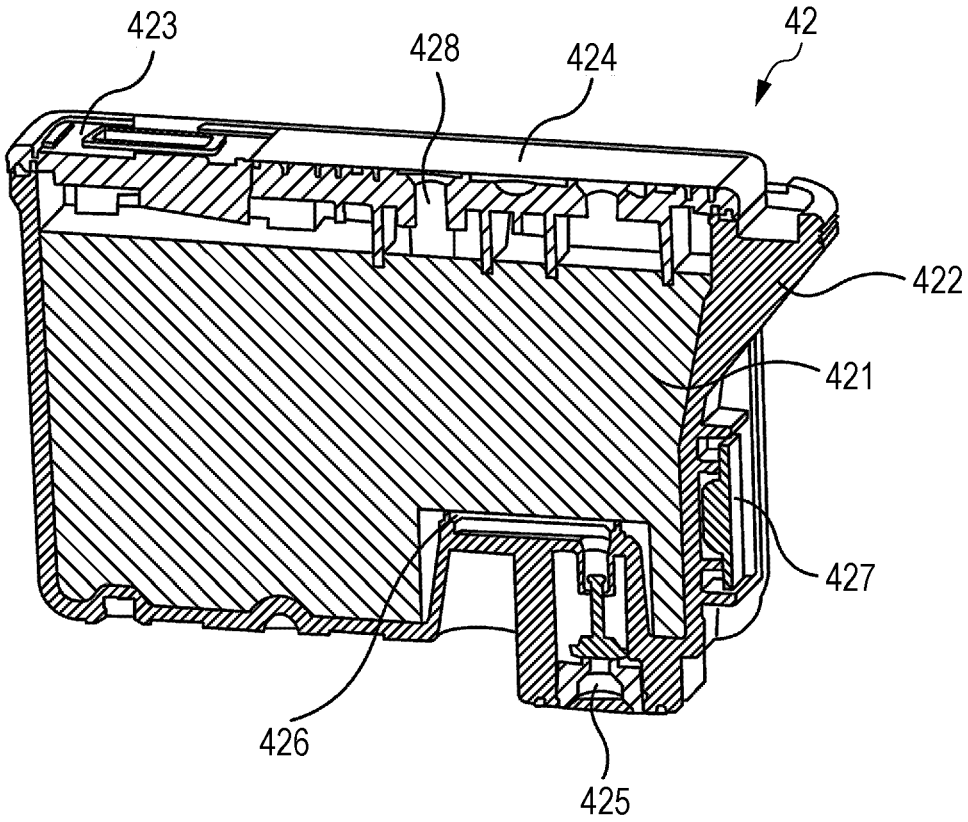
FIG. 4 is a diagram illustrating a foam-type cartridge.

FIG. 4 is a diagram illustrating a foam-type cartridge 42. The cartridge 42 includes a foam 421, a case 422, a cap 423, a label 424, a filter 426, and an IC 427.

The foam 421 is inserted into the case 422. The foam 421 is a sponge, a porous material, or the like, and is permeated with ink. The case 422 and the cap 423 are welded together. The interior of these elements is sealed.

A supply opening 425 is provided in a lower portion of the case 422, and ink is supplied to the head 41 via this supply opening 425. Meanwhile, a vent opening 428 is provided in the cap 423 in order to ensure that the ink is supplied smoothly via the supply opening 425. The filter 426 is provided between the foam 421 and the supply opening 425, and ensures that debris and the like are not supplied to the head 41.

Note that the label 424 is affixed to a top surface of the cap 423 of the cartridge 42 prior to use, and the label 424 is peeled off from the cap 423 when the cartridge 42 is used. The pressure within the cartridge 42 is kept at atmospheric pressure as a result of air being able to flow in from the vent opening 428, which in turn enables the ink to flow out from the supply opening 425.

The IC 427 is fixed to the cartridge 42. At least the manufacture date of the cartridge 42 is recorded in the IC 427. The printer 1 can read out the manufacture date of the cartridge 42 when the cartridge 42 is attached to the carriage 31.

The foam 421 that is permeated with ink is inserted into the cartridge 42 in this manner in order to prevent the ink from leaking. This is because in the case where the printer 1 is, for example, a mobile printer that allows the printer to be transported frequently, simply holding the ink within the cartridge 42 without the foam 421 being inserted carries a risk that the ink will leak while the printer 1 is being transported.

However, in the case where this foam-type cartridge 42 is employed, there is a problem in that when pigment ink settles in the cartridge 42, the foam 421 acts as an obstruction and makes it difficult for the settled ink to disperse. In particular, there are also cases where pigment ink that has settled is highly viscous and it is difficult for the settled ink to disperse.

In the case where ink has settled in a foam-type cartridge 42, and ink is then ejected from the head 41, a phenomenon can occur in which the ink in a central area of the nozzle rows is lighter and the ink in end areas of the nozzle rows is darker.

Figure 5:
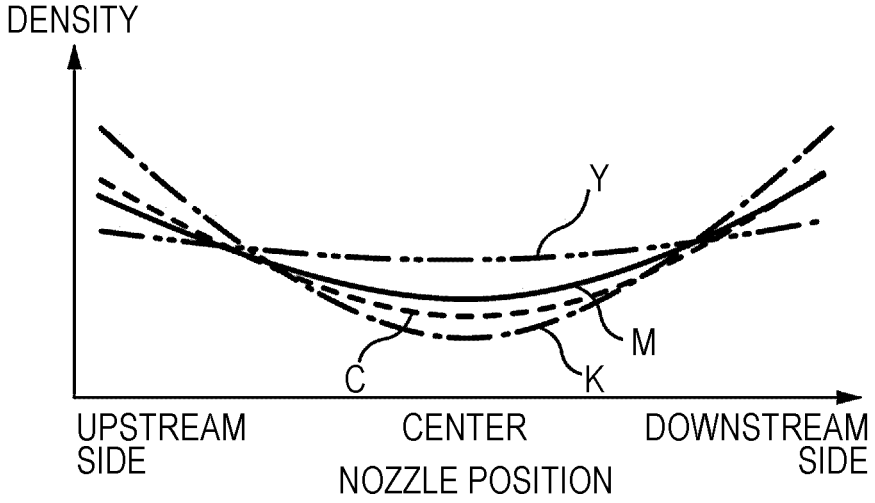
FIG. 5 is a graph illustrating printing densities corresponding to respective nozzles.

FIG. 5 is a graph illustrating printing densities corresponding to respective nozzles. FIG. 5 illustrates densities in the case where settling has occurred in a foam-type cartridge 42 as described above, ink is ejected from the respective nozzles, and the color of the ink is then measured. Here, a high density is referred to as "dark" and a low density is referred to as "light".

Focusing on the black ink K, the ink density is high on an upstream side of the nozzle row (the nozzle #1 side) and a downstream side of the nozzle row (the nozzle #180 side), whereas the ink density is low in the central area of the nozzle row (around nozzle #90).

This also applies to the nozzle rows for the other colors of ink, that is, the ink density is high on the upstream side of the nozzle row (nozzle #1) and the downstream side of the nozzle row (nozzle #48), whereas the ink density is low in the central area of the nozzle row (around nozzle #24). The mechanism by which the settling of ink in the cartridge 42 affects the densities of the inks ejected from the head 41 is unclear at present.

In the case where the ink has settled in the cartridge 42 and a density difference has been produced as described here, density unevenness will occur if the ink is used for printing as-is. As density unevenness reduces printing quality, it is desirable to suppress such density unevenness. A printing method that suppresses the occurrence of such density unevenness will be described next.

Figure 6:
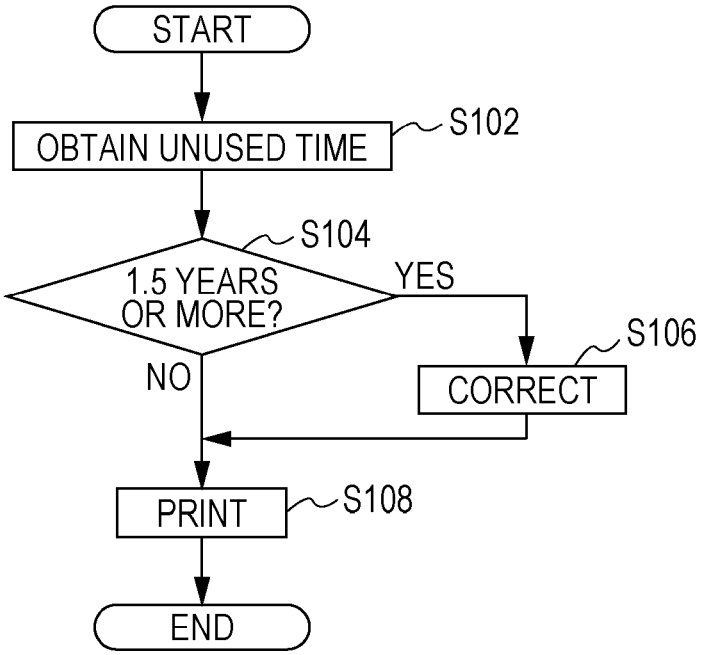
FIG. 6 is a flowchart illustrating a printing method according to a first embodiment.

FIG. 6 is a flowchart illustrating a printing method according to the first embodiment. The printer 1 obtains, from the IC 427 of the cartridge 42, an unused time of the cartridge 42 (corresponding to an elapsed time, and also referred to as an "elapsed time"). This unused time is then sent to the computer 60 (S102). Here, the unused time of the cartridge 42 is an amount of time from the manufacture date of the cartridge 42 to when that cartridge 42 is mounted in the printer 1 and prints for the first time. The unused time is assumed to be recorded in the IC 427 of the cartridge 42 when the cartridge 42 is mounted in the printer 1 and prints for the first time.

The computer 60 then determines whether or not the unused time has exceeded a predetermined number of years (S104). Although 1.5 years is used as the predetermined number of years here, the number of years can be changed depending on the type of the cartridge 42.

In the case where the unused time does not exceed 1.5 years, no special correction is carried out, and printing is executed based on the print data that has been sent (S108). Accordingly, the computer 60 generates the print data normally.

On the other hand, in the case where the unused time exceeds 1.5 years, correction that limits the nozzles used to special nozzles (used nozzles) is carried out (S106), as will be described hereinafter.

Figure 7:
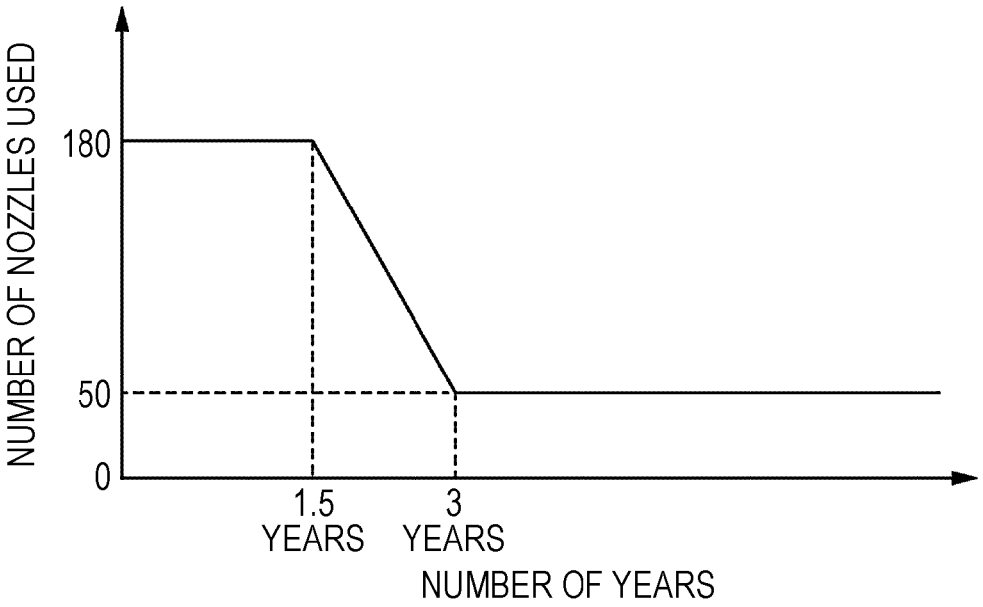
FIG. 7 is a graph illustrating a relationship between an unused time (in years) and a number of used nozzles.

FIG. 7 is a graph illustrating a relationship between the unused time (in years) and a number of used nozzles. In the graph shown in FIG. 7, the horizontal axis represents a number of years that have passed from the manufacture date of the cartridge 42 to when the cartridge 42 is first used, and the vertical axis represents the used nozzles used in the printing that correspond to the number of years that have passed. Note that this graph is a graph that corresponds to the black ink K, and the data in this graph is stored in the computer 60. However, the data in this graph may be stored in the memory 13 of the printer 1 and obtained from the printer 1 by the computer 60. The data in the graph is stored in the memory 13 of the printer 1 even in the case where the printing control apparatus is the controller 10 of the printer 1.

As described earlier, in the case where the unused time does not exceed 1.5 years, the printing is carried out using all of the nozzles, or in other words, 180 nozzles, as the used nozzles. On the other hand, in the case where the unused time exceeds 1.5 years, the number of used nozzles is reduced in correspondence with the unused time. The unused time of the cartridge 42 correlates with the degree to which pigment ink settles. Accordingly, reducing the number of used nozzles in correspondence with the unused time of the cartridge 42 corresponds to reducing the number of used nozzles based on the degree to which pigment ink has settled in the cartridge 42. Here, the number of used nozzles is proportionally reduced by 130 nozzles over a period from when 1.5 years have passed to when three years have passed. In other words, printing is carried out using 50 nozzles when the unused time is three years. Printing is also carried out using 50 nozzles in the case where further years have passed following the passage of the three years.

With respect to the method for reducing the used nozzles, when generating the print data from image data, the computer 60 corrects the print data so that dots are formed only for the used nozzles and dots are not formed for the unused nozzles (S106). The computer 60 then causes the printer 1 to print an image based on the print data corrected in this manner (S108).

Although the number of used nozzles is described here as being reduced by 130 nozzles during the period from when 1.5 years have passed to when three years have passed, the rate at which the used nozzles are reduced maybe faster or slower. Furthermore, the number of years at which the number of used nozzles begins to be reduced is not limited to 1.5 years, and the number of years at which the number of used nozzles is held constant is not limited to three years. Further still, the rate at which the used nozzles are reduced need not be proportional. The method for reducing the number of used nozzles shown in FIG. 7 can be determined based on a relationship between a number of years for which the ink has settled and the density shown in FIG. 5.

Figure 8:
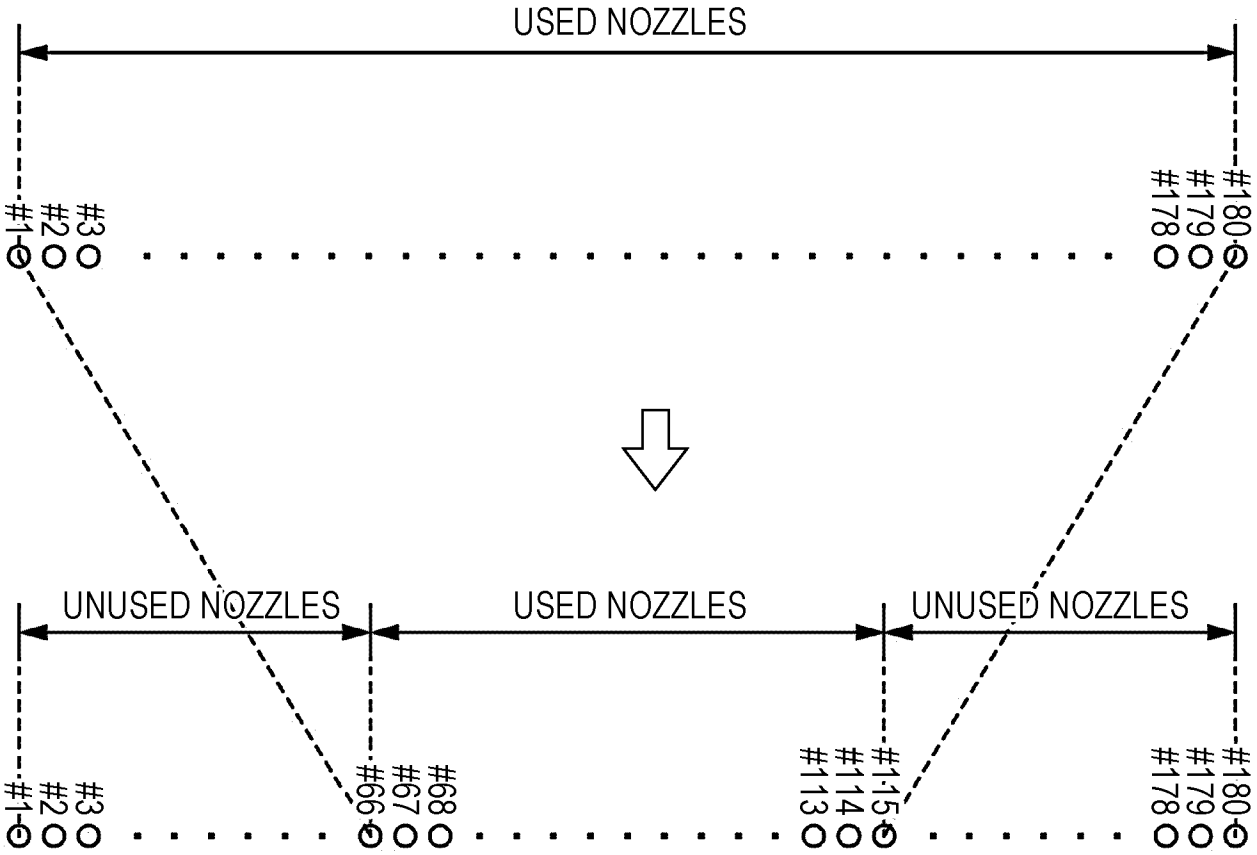
FIG. 8 is a diagram illustrating a method for reducing a number of used nozzles.

FIG. 8 is a diagram illustrating a method for reducing the number of used nozzles. The left side in FIG. 8 illustrates the used nozzles for black ink when the number of years the nozzles have not been used for is 0 years to 1.5 years. The right side in FIG. 8, meanwhile, illustrates the used nozzles when the number of years the nozzles have not been used for has exceeded three years. In this manner, the number of used nozzles is reduced by gradually reducing the nozzles in order, from the end areas of the nozzle row, in a vertically-symmetrical manner.

Figure 9A:
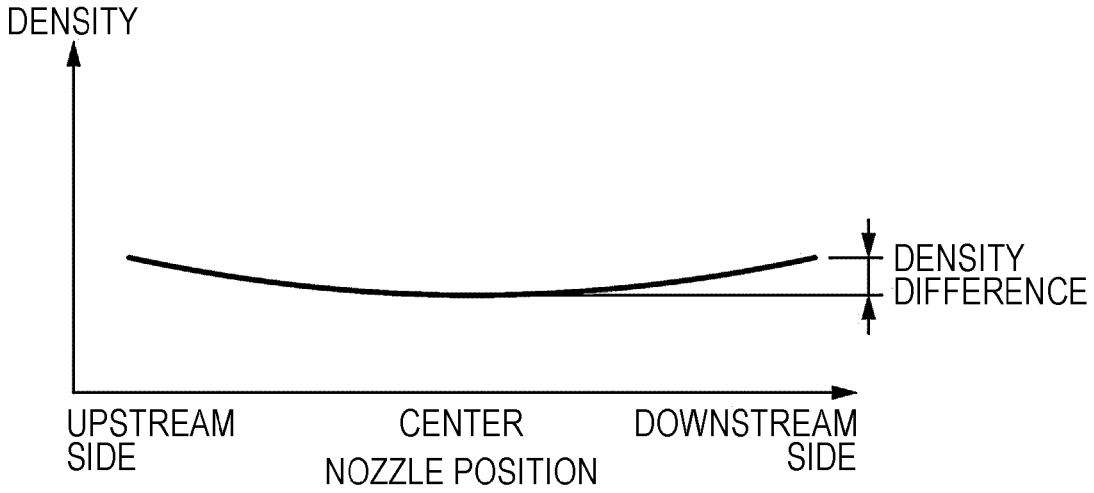
FIG. 9A is a first graph illustrating a relationship between unused time and density.
Figure 9B:
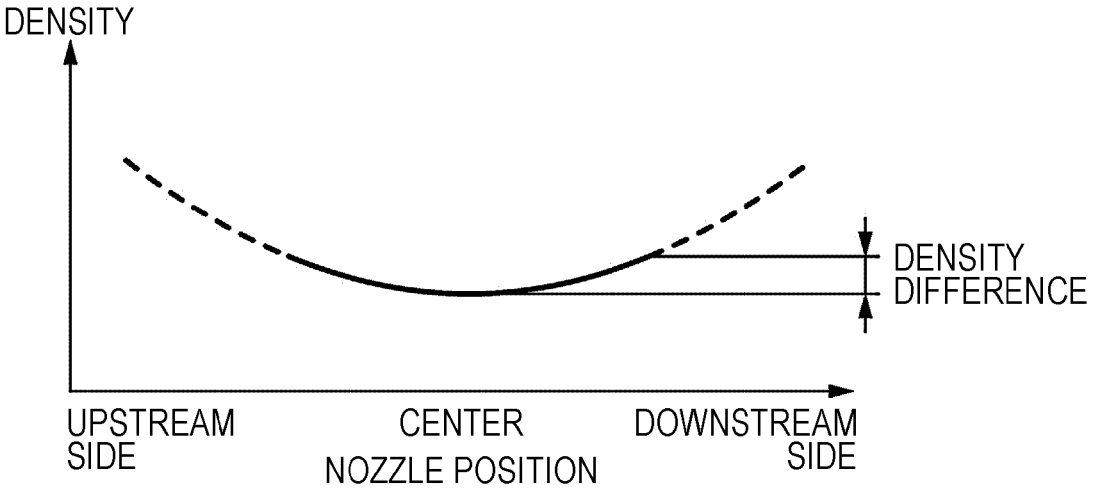
FIG. 9B is a second graph illustrating a relationship between unused time and density.

FIG. 9A is a first graph illustrating a relationship between unused time and density, and FIG. 9B is a second graph illustrating a relationship between unused time and density. FIG. 9A indicates densities corresponding to respective nozzles when the unused time is 1.5 years, whereas FIG. 9B indicates densities corresponding to respective nozzles when the unused time is three years.

A density difference between the nozzles in the central area and the nozzles in the end areas, shown in FIG. 9A, represents a limit value for the density difference permitted by the printer 1. The density difference will increase more when the number of years the nozzles are not used exceeds 1.5 years, and the density difference will exceed the limit value for the permitted density difference.

In FIG. 9B, the unused time is three years. As such, there is a greater density difference between the nozzles in the central area and the nozzles in the end areas. Accordingly, the used nozzles are limited to the nozzles corresponding to the solid line shown in FIG. 9B. In other words, the used nozzles are gradually reduced, starting with the nozzles in the end areas. Doing so makes it possible to keep the density difference among the used nozzles within the permitted density difference range.

Although the foregoing has described black ink as an example, the used nozzles are reduced in almost the same manner for the nozzles that eject ink of other colors. However, because there is a different number of nozzles from the black ink nozzle row, the number of used nozzles can be reduced from 48 nozzles to 13 nozzles during a period from when 1.5 years have passed to when three years have passed.

Meanwhile, the method for reducing the used nozzles may be varied from ink color to ink color. Referring to the aforementioned FIG. 5, the inks aside from the black ink have a lower amount of change in density than the black ink. Accordingly, the method for reducing the used nozzles among the cyan ink nozzles can be less sharp than for the black ink nozzles. Likewise, the method for reducing the used nozzles among the magenta ink nozzles can be less sharp than for the cyan ink nozzles. Furthermore, the method for reducing the used nozzles among the yellow ink nozzles can be less sharp than the method for reducing the used nozzles among the magenta ink nozzles.

With respect to the yellow ink, which experiences the least density difference from unused time, the used nozzles may not be reduced regardless of the unused time.

Furthermore, the unused time at which the used nozzles begin to be reduced and the unused time at which the used nozzles stop being reduced may be set to different years for each of the colors of ink.

By doing so, the density difference between the darkest ink ejected from the used nozzles and the lightest ink ejected from the used nozzles can be reduced. The occurrence of density unevenness can be suppressed as a result.

Second Embodiment

The aforementioned first embodiment describes reducing the number of used nozzles. However, even in the case where the number of used nozzles is reduced in this manner, there are cases where slight differences in densities arise between images formed by different used nozzles. Accordingly, it is also possible to carry out density correction on data corresponding to the used nozzles and then carry out printing. The following describes density correction, using black ink nozzles as an example.

A method that corrects the density at the print data stage by masking the print data and a method that corrects the density at the image data stage by correcting tone values can be given as methods for correcting the density.

The method that corrects the density at the print data stage by masking the print data will be described next.

Figure 10:
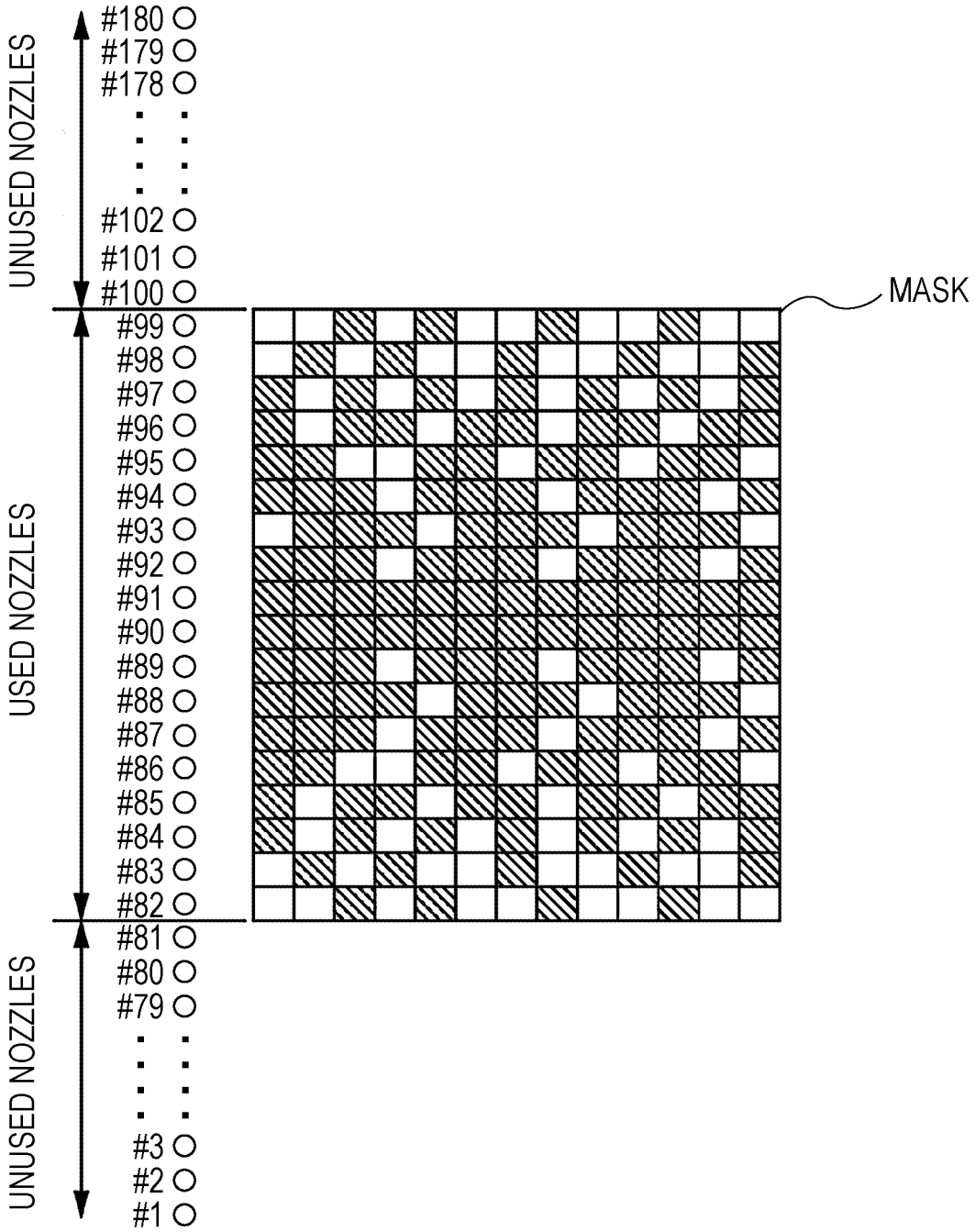
FIG. 10 is a diagram illustrating a mask pattern applied to used nozzles.

FIG. 10 is a diagram illustrating a mask pattern applied to the used nozzles. FIG. 10 illustrates ranges of the used nozzles and the unused nozzles. Here, nozzles #1 to #81 and nozzles #100 to #180 are taken as unused nozzles, and nozzles #82 to #99 are taken as used nozzles.

The print data is data indicating, for each printed pixel, the ink color and size of the dot to be formed. Which nozzle will handle the ejection of ink to each printed pixel is also associated in the print data. The printer 1 ejects ink in order to form the dots corresponding to the printed pixels based on the print data.

However, if the printing is carried out without performing density correction, the density of the image printed by the nozzles toward the end areas will be greater than the density of the image printed by the nozzles toward the center, as described earlier. Accordingly, a mask such as that shown in FIG. 10 is applied to the print data.

Each cell shown in FIG. 10 corresponds to a pixel printed by a used nozzle. Shaded cells represent printed pixels for which ink is permitted to be ejected, whereas blank cells represent printed pixels for which ink is not permitted to be ejected.

As can be seen in FIG. 10, of the cells associated with the used nozzles, a higher percentage of cells are shaded toward the center than toward the end areas. In other words, in the printed pixels toward the center, a higher percentage of ink is permitted to be ejected, whereas in the printed pixels toward the end areas, a lower percentage of ink is permitted to be ejected.

That is, by applying the mask to the print data, the density of the image printed by the used nozzles toward the center can be increased (darkened), and the density of the image printed by the used nozzles toward the end areas can be reduced (lightened).

Next, the method that corrects the density at the image data stage by correcting tone values will be described.

Figure 11:
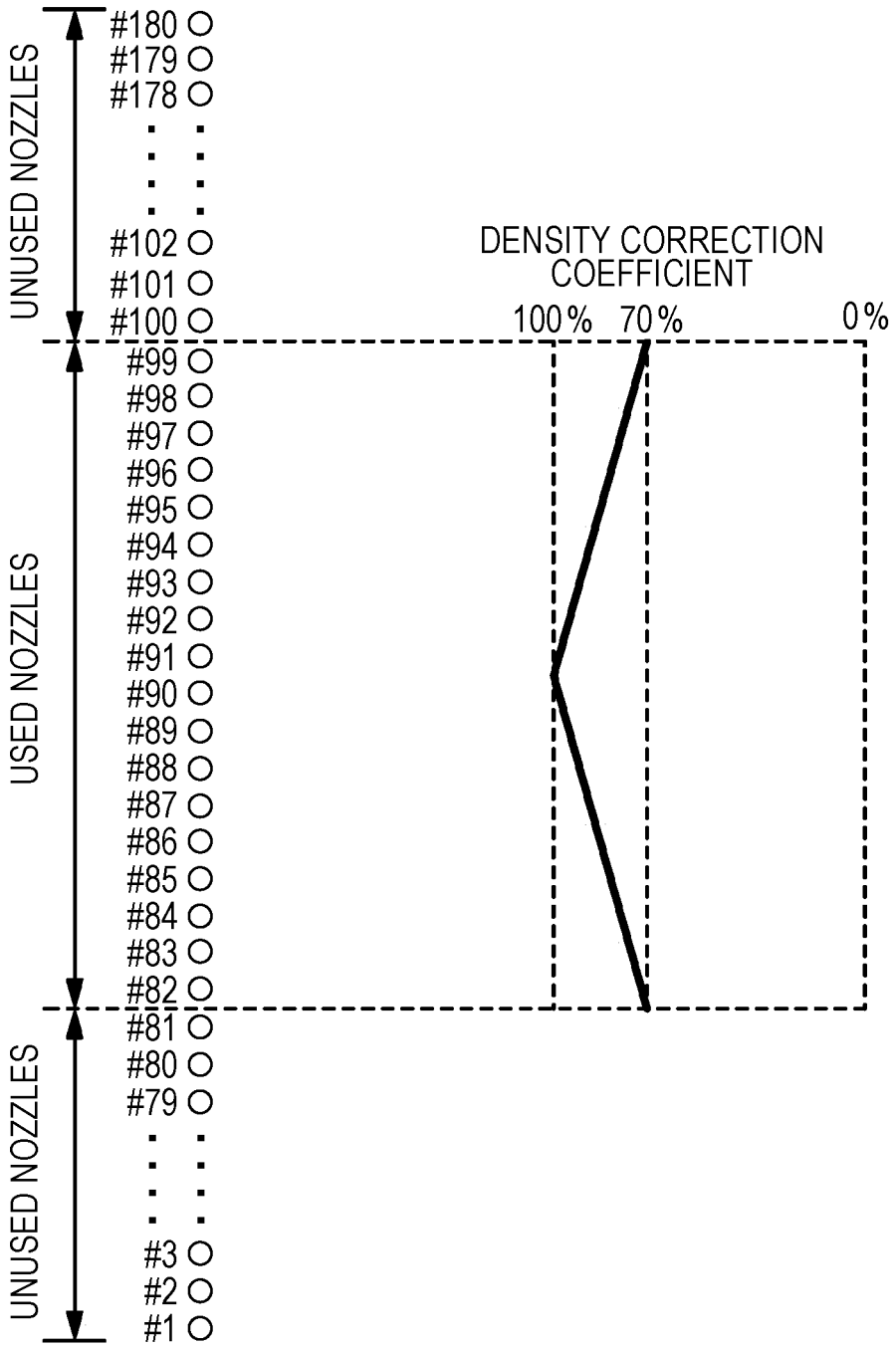
FIG. 11 is a diagram illustrating tone value correction applied to used nozzles.

FIG. 11 is a diagram illustrating tone value correction applied to the used nozzles. FIG. 11 illustrates ranges of the used nozzles and the unused nozzles, as well as density correction coefficients applied to the used nozzles. The density correction coefficients indicated here are percentage values multiplied with the tone values of image data, which will be mentioned later.

As described earlier, slight ink density differences occur even in the used nozzles, and thus if printing is carried out without density correction, the density of an image printed by nozzles toward the end areas will be higher (darker) than the density of an image printed by nozzles toward the center. Accordingly, density correction is carried out in order to reduce the density of an image printed by the nozzles toward the end areas.

The image data is expressed as density values having 256 levels. This image data is multiplied by the density correction coefficients indicated in FIG. 11. The density correction coefficients indicated in FIG. 11 are set so that in the used nozzles, the density of images corresponding to nozzles toward the end areas is lower than the density of images corresponding to nozzles toward the center. Then, when the image data is converted into print data, the density of the printed image corresponding to nozzles toward the end areas is set to be lower than for the nozzles toward the center.

In order to apply such density correction coefficients to the image data, a correspondence relationship between the pixels in the image data and the printed pixels in the print data is found. The printed pixels are associated with the respective used nozzles that eject ink for those printed pixels. Accordingly, it is possible to find which pixel in the image data will be formed by which used nozzle in the print data. To rephrase, an association between a pixel in the image data and the nozzle can be found.

Next, the density value of each pixel is multiplied by the density correction coefficient of the corresponding used nozzle, and a corrected density value is found. The image data containing the corrected density values is then converted into print data, and printing is carried out based on that print data.

By performing density correction such as that described thus far, a density difference in the used nozzles can be reduced. Note that the overall density of the printed image will be reduced as a result of the aforementioned density correction being carried out. Accordingly, the aforementioned density correction may be carried out after first increasing the density value of the corresponding image data.

Other Embodiments

Although the foregoing describes obtaining the unused time of the cartridge 42 from the cartridge 42, information regarding the manufacture date of the cartridge 42 is recorded in the IC 427 when the cartridge 42 is shipped. Then, when the cartridge 42 is mounted in the printer 1 and the first print is started, the unused time is found based on the manufacture date of the cartridge 42 and the starting time of the first print. The unused time is then recorded in the cartridge 42.

In addition, although the unused time has been described as corresponding to the elapsed time, an amount of time from when the cartridge 42 is mounted and the first print is carried out to when the next print is carried out can also correspond to the elapsed time. Furthermore, the amount of time from when a given print is carried out to when the next print is carried out can correspond to the elapsed time, and a total of those times can also correspond to the elapsed time. A combination of these can be taken as corresponding to the elapsed time. Note that in the case where the elapsed time changes, as when the amount of time from when a given print is executed to when the next print is executed is taken as the elapsed time, it is assumed that print time information is recorded in the IC 427 of the cartridge 42.

In addition, the controller 10 of the printer 1 may serve as the printing control apparatus. By doing so, the printer 1 can be employed as a mobile printer that does not use the computer 60. This is advantageous in, for example, the case where a memory card is inserted into a slot in the printer 1 and used, the case where an image obtained from a smartphone is sent to the printer 1 and printed, and so on.

In addition, the computer 60 and the controller 10 can also serve as the printing control apparatus. In the case where the computer 60 and the controller 10 serve as the printing control apparatus in such a manner, the printer 1 can calculate the number of years that have passed and the density correction coefficients, and the computer 60 can then correct the print data, the image data, and so on.

Although the aforementioned embodiments describe the printer 1 as a target of the control performed by the printing control apparatus, the invention is not limited thereto; the invention can also be applied in a liquid ejection apparatus that expels or ejects a fluid aside from ink (liquids, liquid materials in which the particles of a functional material have been dispersed, fluid materials such as gels, and so on). The same techniques as those described in the aforementioned embodiments may be applied to various types of apparatuses that employ ink jet techniques, such as color filter manufacturing apparatuses, dyeing apparatuses, microfabrication apparatuses, semiconductor manufacturing apparatuses, surfacing apparatuses, three-dimensional molding machines, liquid vaporizing apparatuses, organic EL manufacturing apparatuses (and in particular, high-polymer EL manufacturing apparatuses), display manufacturing apparatuses, deposition apparatuses, DNA chip manufacturing apparatuses, and so on. The methods used thereby and manufacturing methods thereof also fall within the scope of application of the invention.

The aforementioned embodiments have been provided to facilitate understanding of the invention and are not to be interpreted as limiting the invention in any way. It goes without saying that many variations and modifications can be made without departing from the essential spirit of the invention, and thus all such variations and modifications also fall within the scope of the invention.

What is claimed is:

1. A printing control apparatus that controls ejection of a pigment ink, supplied from a cartridge, from a nozzle row having a plurality of nozzles, wherein time information regarding an elapsed time of the cartridge is obtained, and used nozzles, in the nozzle row, that form dots of an image on a printing medium based on image data by ejecting the pigment ink on to the printing medium during image printing are reduced based on the time information of the cartridge.

2. The printing control apparatus according to claim 1, wherein when reducing a number of the used nozzles, the used nozzles are reduced so that nozzles toward the center of the nozzle row are used.

3. The printing control apparatus according to claim 1, wherein a different means for reducing the used nozzles is used for each color of the pigment ink.

4. The printing control apparatus according to claim 1, wherein when reducing the used nozzles that eject the pigment ink, a rate at which the used nozzles for yellow ink are reduced is slower than a rate at which the used nozzles for other colors of ink are reduced.

5. The printing control apparatus according to claim 1, wherein the cartridge contains a material permeated with the pigment ink.

6. The printing control apparatus according to claim 1, wherein the elapsed time of the cartridge is a time related to an amount of time from when the cartridge was manufactured.

7. A control method for controlling ejection of a pigment ink, supplied from a cartridge, from a nozzle row having a plurality of nozzles, the method comprising:

obtaining time information regarding an elapsed time of the cartridge; and reducing the nozzles in the nozzle row that are used to form dots on a printing medium to form dots of an image on the printing medium based on image data by ejecting the pigment ink on the printing medium during image printing based on the time information.

8. A non-transitory computer readable storage medium storing computer program, the program causing a printing control apparatus to eject a pigment ink, supplied from a cartridge, from a nozzle row having a plurality of nozzles, the program causing the apparatus to:

obtain time information regarding an elapsed time of the cartridge; and reduce the nozzles in the nozzle row that are used to form dots on a printing medium to form dots of an image on the printing medium based on image data by ejecting the pigment ink on the printing medium during image printing based on the time information.

* * * * *